US009633805B2

(12) United States Patent
Kuo

(10) Patent No.: US 9,633,805 B2
(45) Date of Patent: Apr. 25, 2017

(54) PUSHBUTTON SWITCH

(71) Applicant: Excel Cell Electronic Co., ltd., Taichung (TW)

(72) Inventor: Yung-Ming Kuo, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 14/817,400

(22) Filed: Aug. 4, 2015

(65) Prior Publication Data

US 2016/0064162 A1 Mar. 3, 2016

(30) Foreign Application Priority Data

Sep. 3, 2014 (TW) ..... 103130380 A

(51) Int. Cl.
*H01H 3/12* (2006.01)
*H01H 13/14* (2006.01)
*H01H 13/52* (2006.01)

(52) U.S. Cl.
CPC ..... *H01H 13/52* (2013.01); *H01H 3/122* (2013.01); *H01H 2221/058* (2013.01); *H01H 2235/018* (2013.01); *H01H 2235/028* (2013.01)

(58) Field of Classification Search
CPC ..... H01H 13/52; H01H 13/122; H01H 2235/028; H01H 2221/058; H01H 2235/018
USPC ..... 200/520, 341, 344
See application file for complete search history.

(56) References Cited

U.S. PATENT DOCUMENTS

2013/0048482 A1* 2/2013 Saitou ..... H01H 13/06 200/341

FOREIGN PATENT DOCUMENTS

| | | |
|---|---|---|
| CN | 102117706 A | 7/2011 |
| TW | 201013719 A | 4/2010 |
| TW | M379157 U1 | 4/2010 |

* cited by examiner

*Primary Examiner* — Felix O Figueroa
*Assistant Examiner* — Lheiren Mae A Caroc
(74) *Attorney, Agent, or Firm* — Trop Pruner & Hu, P.C.

(57) ABSTRACT

A pushbutton switch includes a pushbutton unit and a resilient member. The pushbutton unit includes a mounting seat for being in proximity to an activator of a switch assembly, and a pushbutton covering the mounting seat. The resilient member has a switch contactor adjacent to the activator, two resilient arms extending from the switch contactor, and two abutment segments connected respectively to the resilient arms and engaging the limiting seat. When the pushbutton is pressed to move toward the limiting seat, the resilient arms are resiliently deformed to have a resilient force for urging the pushbutton away from the limiting seat, and the switch contactor is driven by the pushbutton to contact and move the activator.

8 Claims, 21 Drawing Sheets

PUSHBUTTON SWITCH

CROSS-REFERENCE TO RELATED APPLICATION

This application claims priority of Taiwanese Application No. 103130380, filed on Sep. 3, 2014.

FIELD OF THE DISCLOSURE

The disclosure relates to a pushbutton switch, and more particularly to a pushbutton switch having a resilient member.

BACKGROUND OF THE DISCLOSURE

Referring to FIGS. 1 and 2, a first conventional pushbutton switch 1 is suited for connection with a switch assembly (not shown). The first conventional pushbutton switch 1 includes a mount seat 11, a pushbutton 12 that covers the mount seat 11 and cooperates with the mount seat 11 to define a receiving space 13, and a spring 14 that is disposed inside the receiving space 13. The spring 14 has two opposite ends that respectively abut against the mount seat 11 and the pushbutton 12, and urges the pushbutton 12 to move away from the mount seat 11.

Referring to FIGS. 3 and 4, in order to activate the switch assembly, the pushbutton 12 is pushed to be in proximity to the mount seat 11, thereby causing compression of the spring 14. However, since the spring 14 only contacts a center portion of the pushbutton 12, when an external force is exerted at a corner of the pushbutton 12, the external force may not be effectively transmitted to the spring 14. As such, actuation of the switch assembly may be hampered by inefficient compression of the spring 14.

Referring to FIGS. 5 and 6, a second conventional pushbutton switch 1' for connection with a switch assembly (not shown) includes a pushbutton 12, a mount seat 11 that is covered by the pushbutton 12, and four springs 14 that are respectively disposed below four corners of the pushbutton 12. However, since the springs 14 are independent from each other, when one of the corners of the pushbutton 12 is pressured by an external force, only a corresponding one of the springs 14 is compressed by the external force. That is to say, the external force is unable to be transmitted to the rest of the springs 14. As a result, the actuation of the switch assembly (not shown) is still hampered.

In addition, in order to actuate the switch assembly (not shown), the pushbutton 12 of each of the first and second conventional pushbutton switches 1, 1' further includes a contact member 15 that extends from an inner surface of the pushbutton 12 for making electrical contact with the switch assembly when the pushbutton 12 is pushed to be in proximity to the mount seat 11. Accordingly, when the pushbutton 12 is moved toward the mount seat 11, the contact member 15 is moved together with the pushbutton 12 to actuate the switch assembly (not shown). However, the spring 14 and the contact member 15 of the conventional push button switches 1, 1' confer a relatively complicated structure and a relatively high manufacturing cost to the conventional push button switches 1,1'.

SUMMARY OF THE DISCLOSURE

Therefore, an object of the present disclosure is to provide a pushbutton switch that can alleviate at least one of the drawbacks of the prior arts.

According to one aspect of the present disclosure, the pushbutton switch is adapted to be connected to an activator of a switch assembly. The pushbutton switch includes a pushbutton unit and a resilient member.

The pushbutton unit includes a limiting seat and a pushbutton. The limiting seat is adapted to be disposed in proximity to the activator. The pushbutton covers the limiting seat and cooperates with the limiting seat to define a receiving space.

The resilient member is disposed in the receiving space, and has a switch contactor, two resilient arms and two abutment segments. The switch contactor is adapted to be disposed adjacent to the activator, and has opposite ends spaced apart from each other in an extending direction. The resilient arms extend respectively from the opposite ends of the switch contactor toward the pushbutton. The abutment segments are respectively connected to the resilient arms, and engage the limiting seat.

When the pushbutton is pressed to move toward the limiting seat, the resilient arms are resiliently deformed to have a resilient force for urging the pushbutton away from the limiting seat, and the switch contactor is driven by the pushbutton to contact and move the activator.

Another object of the present disclosure is to provide a resilient member adapted for use in a pushbutton switch. The pushbutton switch is connected to an activator of a switch assembly, and includes a limiting seat that is disposed in proximity to the activator, and a pushbutton that covers the limiting seat to define a receiving space. The resilient member is disposed in the receiving space and includes a switch contactor, two resilient arms and two abutment segments.

The switch contactor is adapted to be adjacent to the activator, and has opposite ends spaced apart from each other in an extending direction.

The resilient arms are adapted to extend respectively from the opposite ends of the switch contactor toward the pushbutton.

The abutment segments are respectively connected to the resilient arms, and engage the limiting seat.

When the pushbutton is pressed to move toward the limiting seat, the resilient arms are resiliently deformable to have a resilient force adapted for urging the pushbutton away from the limiting seat, and to drive the switch contactor to contact and move the activator when the pushbutton is pressed to move toward the limiting seat.

BRIEF DESCRIPTION OF THE DRAWINGS

Other features and advantages of the present disclosure will become apparent in the following detailed description of the embodiments with reference to the accompanying drawings, of which.

DETAILED DESCRIPTION OF THE EMBODIMENTS

Figure 1:
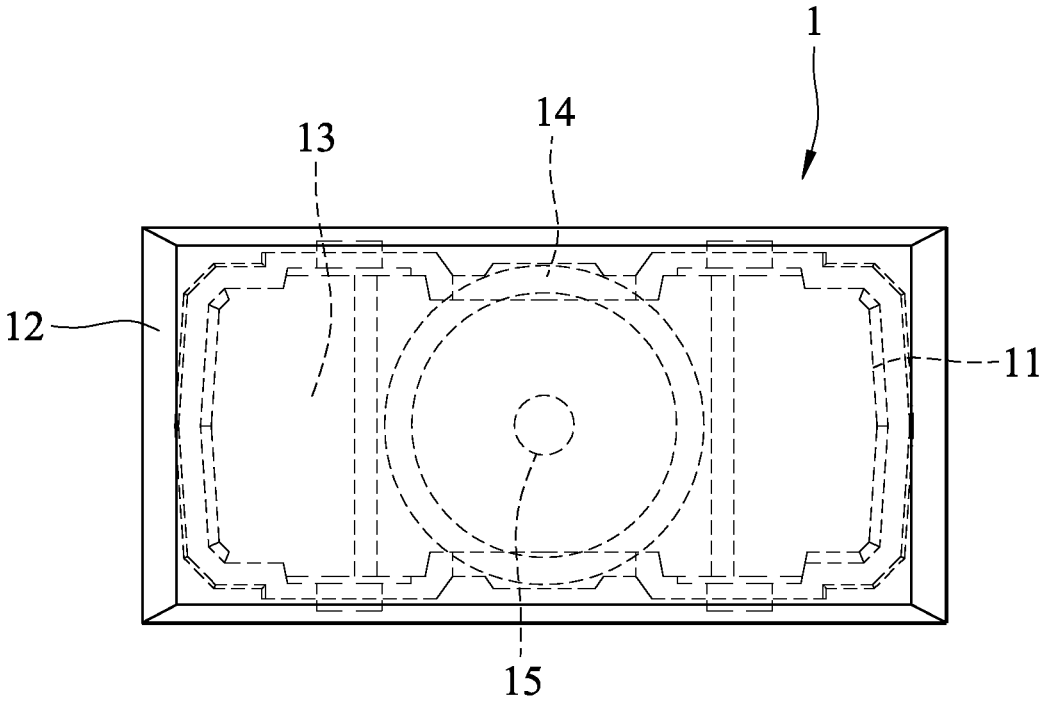
FIG.1 PRIOR ART
FIG. 1 is a top view illustrating a first conventional pushbutton switch.
Figure 2:
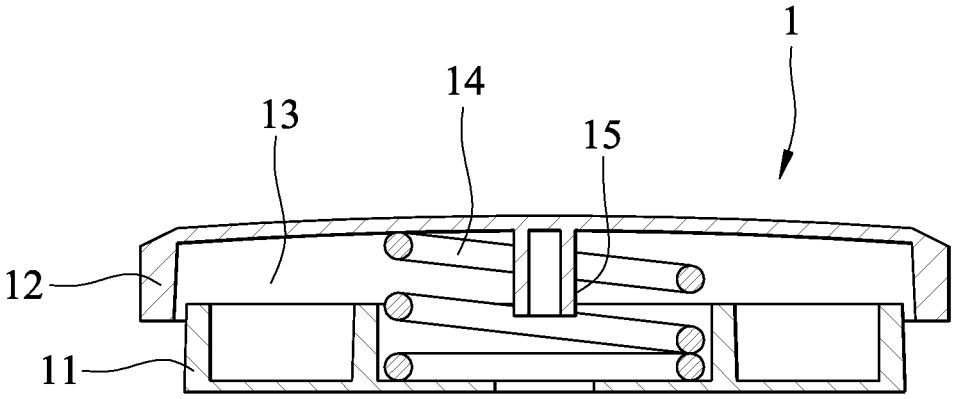
FIG.2 PRIOR ART
FIG. 2 is a sectional view of the first conventional pushbutton switch before a pushbutton is pressed.
Figure 3:
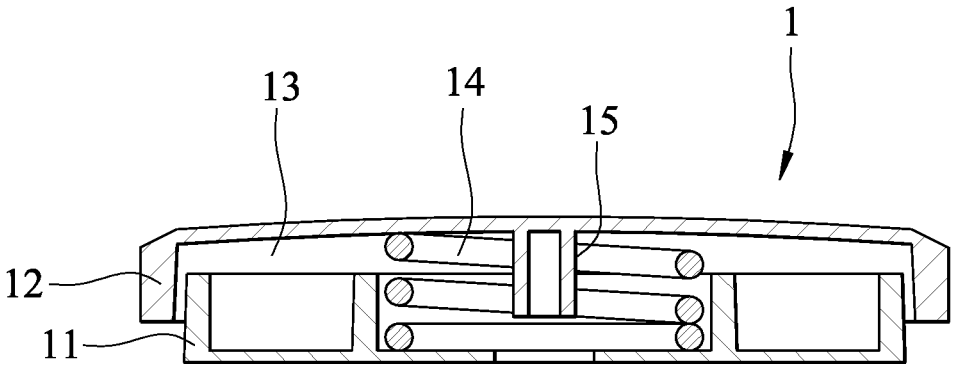
FIG.3 PRIOR ART
FIG. 3 is a sectional view of the first conventional pushbutton switch when the pushbutton is pressed.
Figure 4:
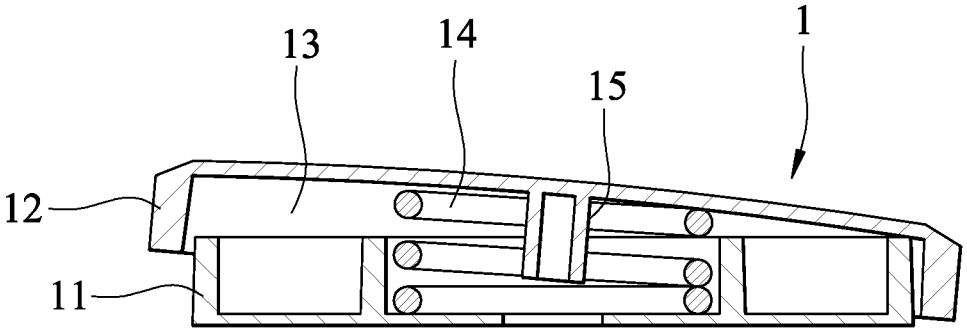
FIG.4 PRIOR ART
FIG. 4 is a sectional view of the first conventional pushbutton switch when a corner of the pushbutton is pressed.
Figure 5:
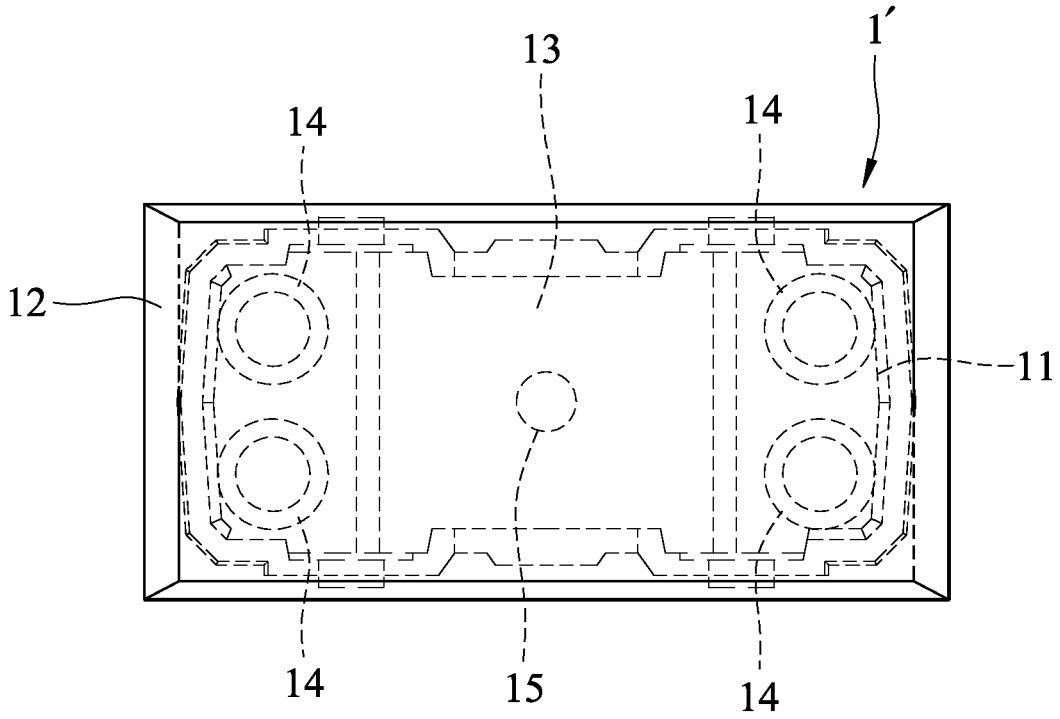
FIG.5 PRIOR ART
FIG. 5 is a top view illustrating a second conventional pushbutton switch.
Figure 6:
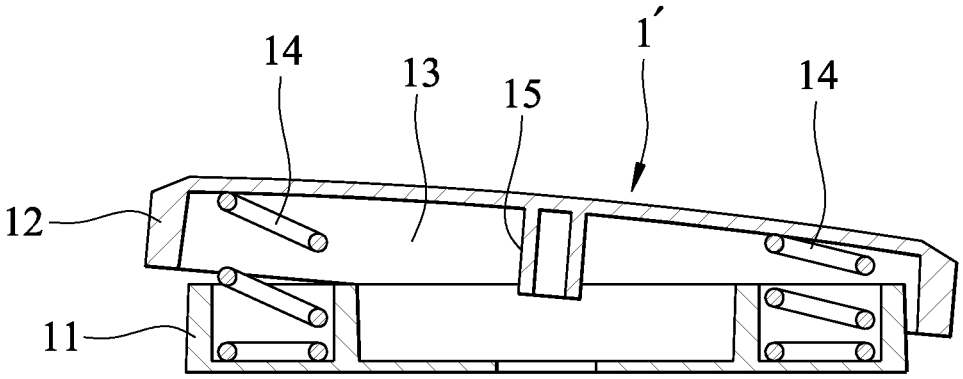
FIG.6 PRIOR ART
FIG. 6 is a sectional view of the second conventional pushbutton switch when a corner of a pushbutton is pressed.

Before the pre sent disclosure is described in greater detail, it should be noted that like elements are denoted by the same reference numerals throughout the disclosure.

Figure 7:
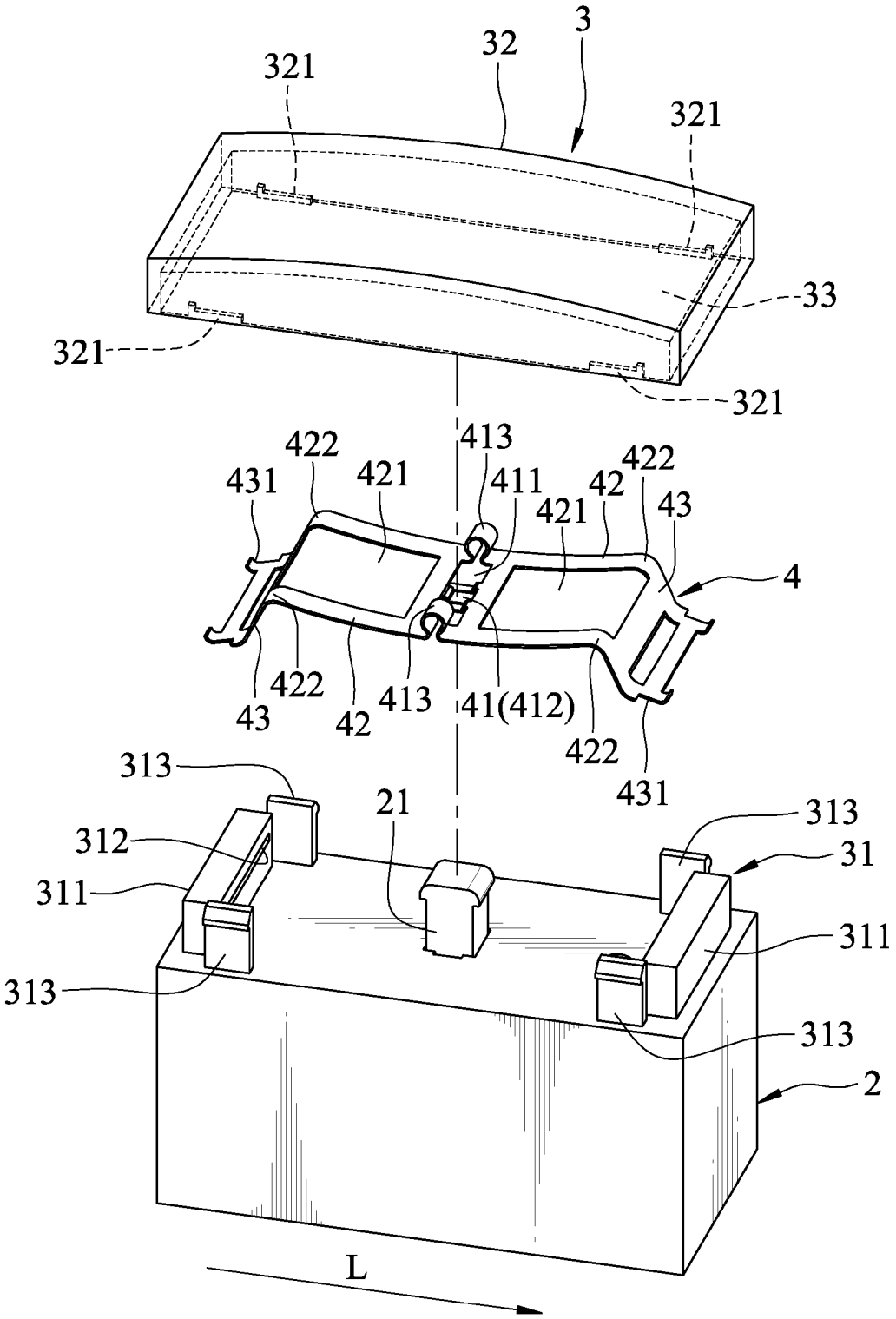
FIG. 7 is an exploded perspective view illustrating the first embodiment of a pushbutton switch according to the present disclosure.
Figure 8:
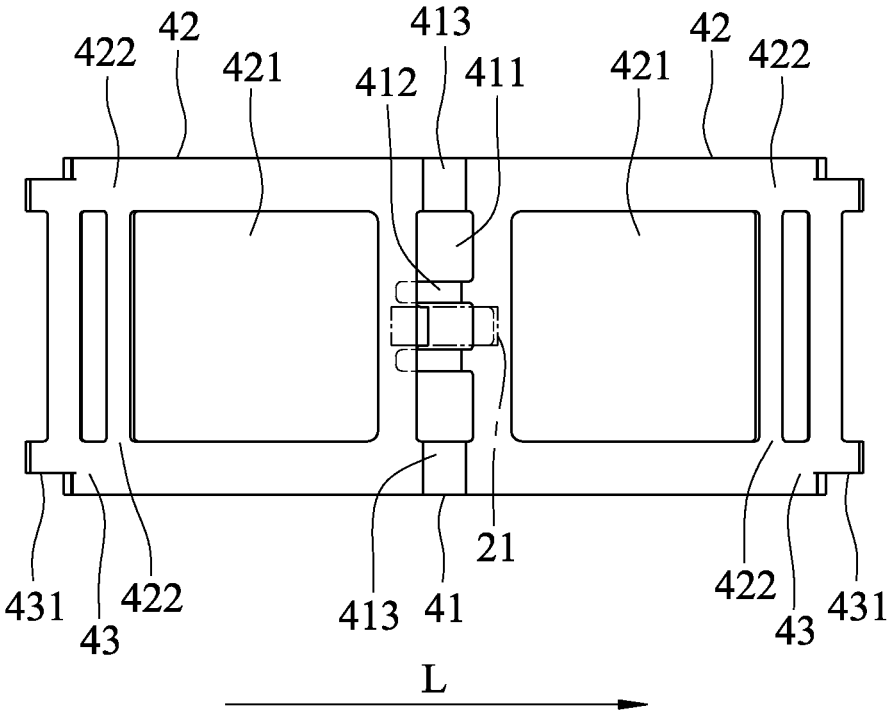
FIG. 8 is a top view of a resilient member of the first embodiment.
Figure 9:
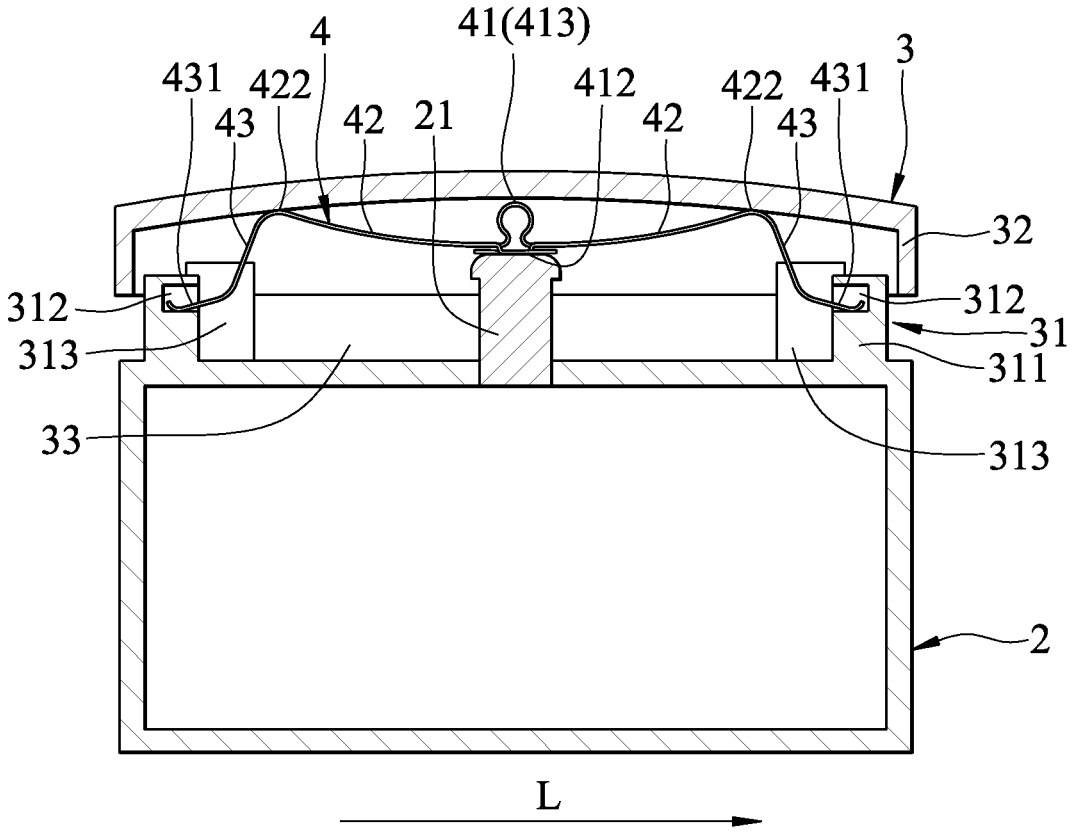
FIG. 9 is a sectional view of the first embodiment before a pushbutton is pressed.

Referring to FIGS. 7 to 9, the first embodiment of a pushbutton switch according to the present disclosure is suitable for a switch assembly 2. The switch assembly 2 includes an activator 21.

The pushbutton switch includes a pushbutton unit 3 and a resilient member 4.

In this embodiment, the pushbutton unit 3 includes a limiting seat 31 that is adapted to be disposed in proximity to the activator 21, and a pushbutton 32 that covers the limiting seat 31 and that cooperates with the limiting seat 31 to define a receiving space 33.

The limiting seat 31 includes two seat blocks 311 that are adapted to be disposed respectively in two opposite sides of the activator 21 in an extending direction (L). Each of the seat blocks 311 is formed with a sliding groove 312 that opens toward the activator 21. The limiting seat 31 further includes four limiting portions 313. Two of the limiting portions 313 are spaced apart from each other in a transverse direction transverse to the extending direction (L), and flank one of the seat blocks 311. The other two of the limiting portions 313 are spaced apart from each other in the transverse direction and flank the other one of the seat blocks 311.

In this embodiment, each of the limiting portions 313 is configured as a hook, and the limiting seat 31 and the switch assembly 2 are integrally formed as one piece. However, in other embodiments of the present disclosure, the limiting seat 31 and the switch assembly 2 may be individually formed and coupled together.

In this embodiment, the pushbutton 32 has four locking portions 321 that are disposed on an inner surface thereof. Each of the locking portions 321 is configured as an L-shaped protrusion, and engages a respective one of the limiting portions 313 of the limiting seat 31 to lock the pushbutton 32 to the limiting seat 31, and to prevent movement of the pushbutton 32 in the extending direction (L) relative to the limiting seat 31.

In this embodiment, the resilient member 4 is disposed in the receiving space 33, and has a switch contactor 41, two resilient arms 42 and two abutment segments 43. The switch contactor 41 is adapted to be disposed adjacent to the activator 21, and has opposite ends spaced apart from each other in the extending direction (L). The resilient arms 42 extend respectively from the opposite ends of the switch contactor 41 toward the pushbutton 32. The abutment segments 43 are respectively connected to the resilient arms 42, and engage respectively the seat blocks 311 of the limiting seat 31.

Figure 10:
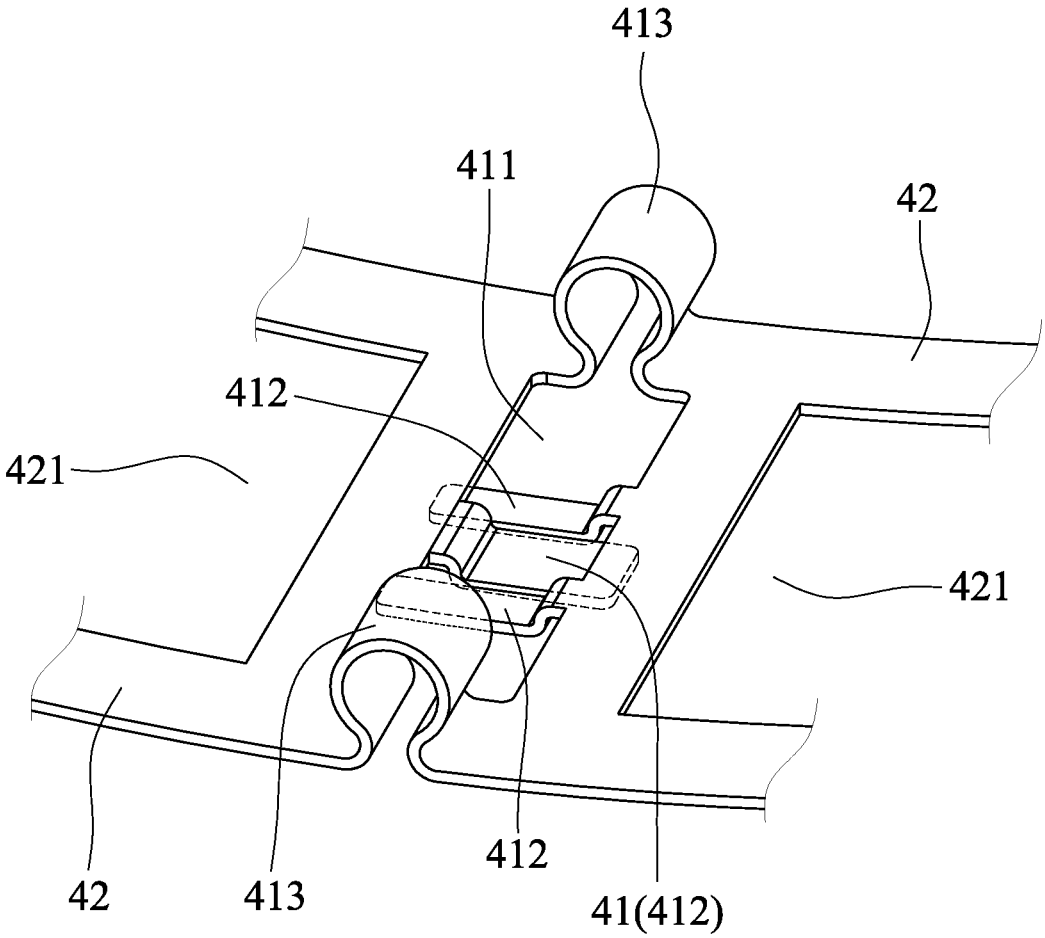
FIG. 10 is a fragmentary perspective view illustrating the resilient member of the first embodiment.

As shown in FIGS. 8 and 10, the switch contactor 41 further has a void 411 that is formed at a center thereof, three contact plates 412 that are disposed in the void 411, and two linking portions 413 that are spaced apart from each other in the transverse direction and that are separated by the void 411. Each of the linking portions 413 has a drop-shaped cross-section (see FIG. 7) that extends toward the pushbutton 32. Specifically, the linking portions 413 interconnect the resilient arms 42 for force transmission between the resilient arms 42 so as to enhance force sensitivity of the resilient member 4.

In this embodiment, one of the contact plates 412 is connected to one of the resilient arms 42. The other two of the contact plates 412 are disposed at opposite sides of the one of the contact plates 412 and connected to the other one of the resilient arms 42. However, in other embodiments of the pushbutton switch, the number of the contact plates 412 may vary.

With reference to FIGS. 7 to 9, each of the resilient arms 42 is curved, and has two elongated parts spaced apart from each other in the transverse direction, and an opening 421 separating the elongated parts from each other. Each of the resilient arms 42 further has two support sections 422 formed respectively at distal ends of the elongated parts which are distal from the switch contactor 41. The support sections 422 of the resilient arms 42 are disposed to correspond respectively in position to four corners of the pushbutton 32. In this embodiment, the support sections 422 of the resilient arms 42 abut permanently and resiliently against the pushbutton 32. In other embodiments of the present disclosure, it is only until the pushbutton 32 is pressed will the support sections 422 contact the pushbutton 32.

In this embodiment, each of the abutment segments 43 extends from a distal end of a respective one of the resilient arms 42, and has a sliding section 431 that is distal from the distal end of the respective one of the resilient arms 42 and that slidably engages the sliding groove 312 of a respective one of the seat blocks 311 of the limiting seat 31. As such, the sliding section 431 of each of the abutment segments 43 is slidable relative to the limiting seat 31 when the respective one of the resilient arms 42 is deformed.

Figure 11:
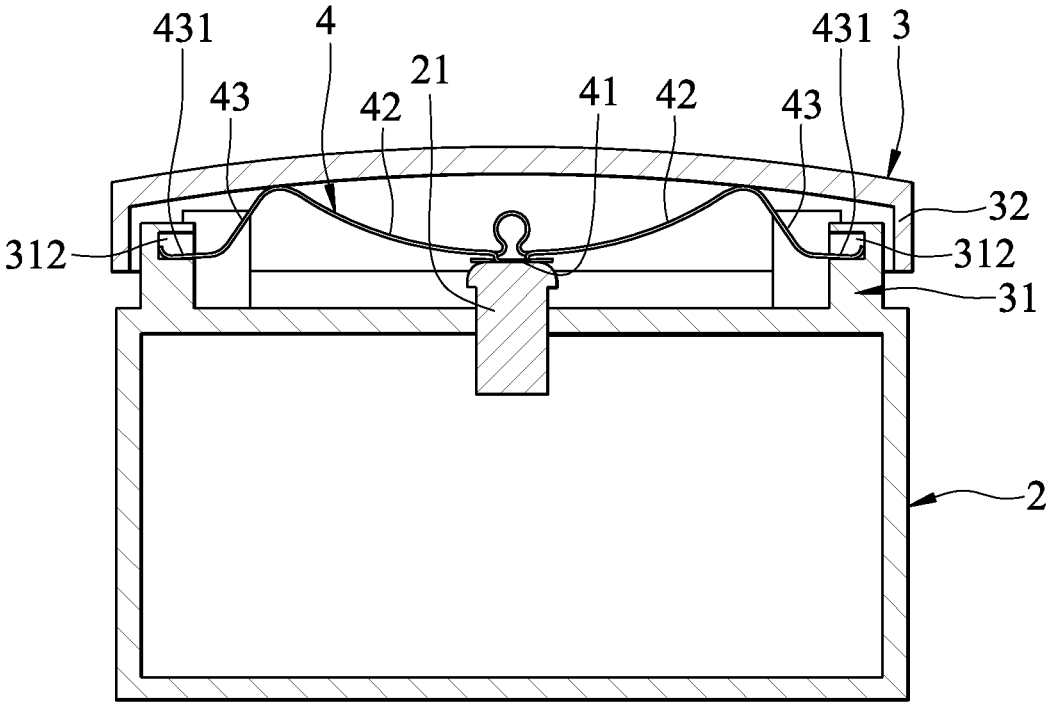
FIG. 11 is a sectional view of the first embodiment when the pushbutton is pressed.

Referring to FIG. 11, when the pushbutton 32 is pressed to move toward the limiting seat 31, the resilient arms 42 are resiliently deformed to have a resilient force for urging the pushbutton 32 away from the limiting seat 31, and the switch contactor 41 is driven by the pushbutton 32 to contact and move the activator 21, thereby actuating the switch assembly 2. The sliding movement of the sliding section 431 of each of the abutment segments 43 would be stopped by a groove-defining surface which defines the respective one of the sliding grooves 312 so as to arrest deformation of the resilient arms 42.

In the first embodiment, the switch assembly 2 further includes a restoring mechanism (not shown) for automatically restoring the activator 21 to an undeformed position. When the pushbutton 32 is released, not only can the resilient force of the resilient arms 42 urge the pushbutton 32 away from the limiting seat 31, but the activator 21 is also moved by the restoring mechanism together with the pushbutton 32.

Figure 12:
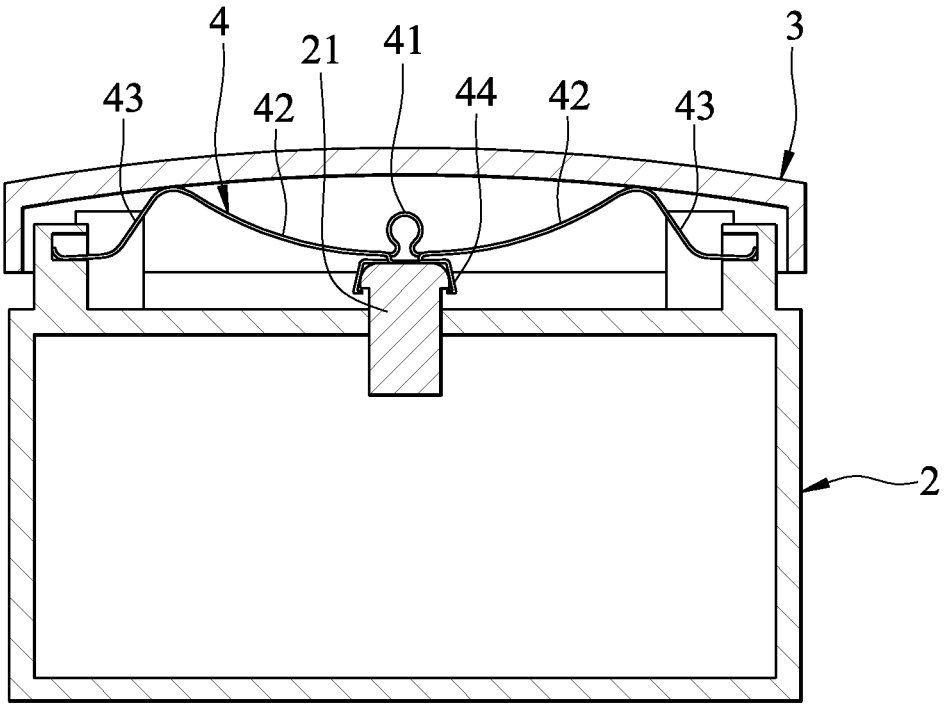
FIG. 12 is a sectional view of a modification of the first embodiment.

FIG. 12 illustrates a modification of the switch assembly 2 in which the restoring mechanism is omitted and the resilient member 4 further has a clip segment 44. The clip segment 44 is connected to the switch contactor 41 and is adapted to clip the activator 21. Therefore, when the pushbutton is released, the resilient force of the resilient arms 42 can restore the activator 21 as well. Specifically, the contact plates 412 are bent to form the clip segment 44.

In view of the above, the pushbutton switch has the following advantages:

1. Since the resilient member 4 serves not only to move the activator 21 when the pushbutton 32 is pushed but also to restore the pushbutton 32 when the pushbutton 32 is released, the pushbutton switch of this disclosure has a simplified structure.

2. Since the resilient member 4 is formed into one piece, and since the four support sections 422 of the resilient arms 42 respectively and resiliently abut against the four corners of the pushbutton 32, the external force can act anywhere on the pushbutton 32 to be uniformly transmitted through the resilient member 4, thereby enhancing smoothness when pressing the pushbutton 32 and increasing touch sensitivity of the switch assembly 2.

3. By adjusting the depth of the sliding grooves 312, the extent of deformation of the resilient arms 42 can be controlled. Therefore, the resilient arms 42 are prevented from being excessively deformed to be fractured, or being excessively restored to damage the pushbutton switch.

4. The resilient member 4 provides a relatively short distance of movement for the pushbutton 32 without affecting the restoring force of the resilient arms 42 for restoring the pushbutton 32, thereby making the pushbutton switch suitable for use in a miniaturized electronic device.

Figure 13:
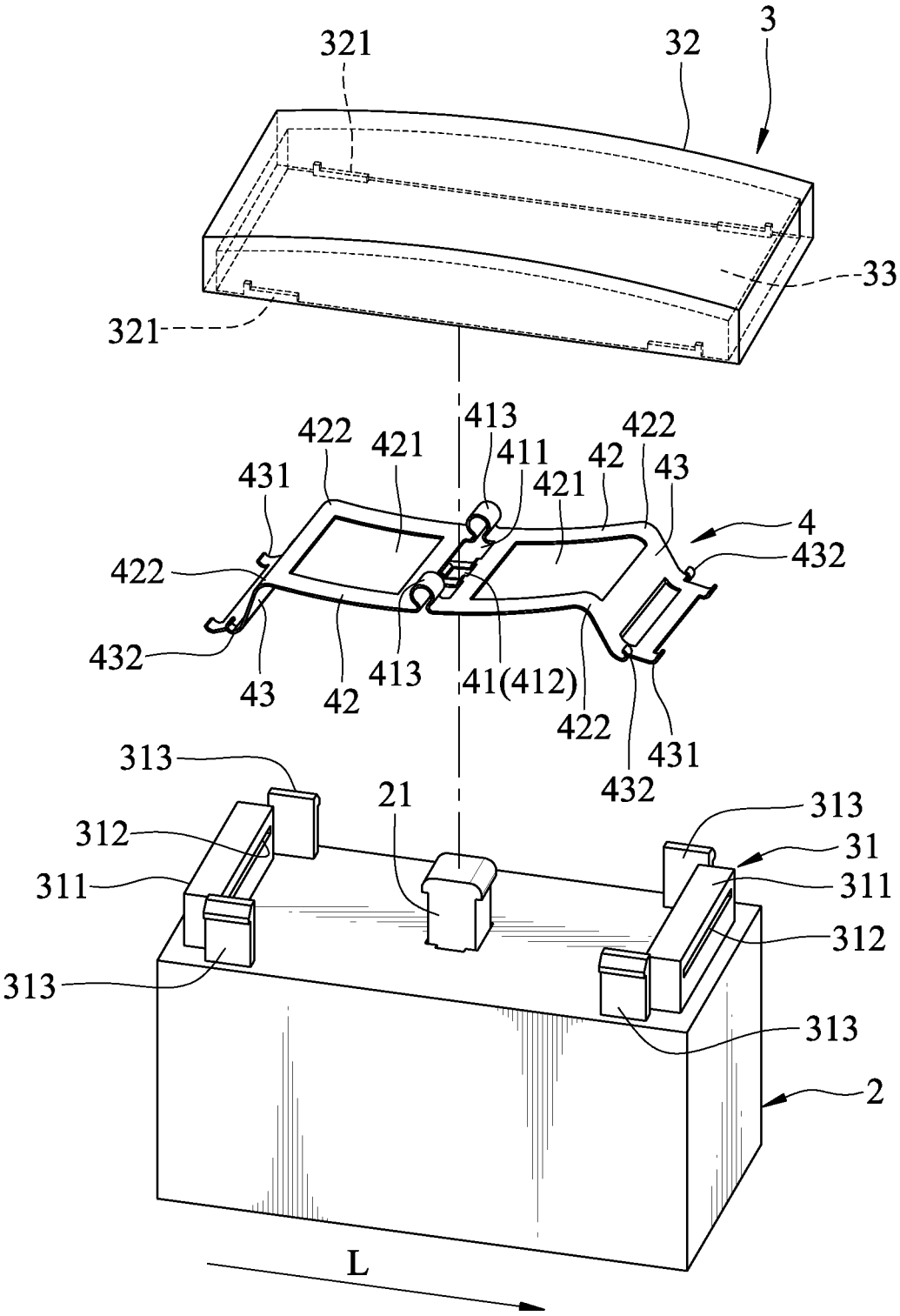
FIG. 13 is an exploded perspective view illustrating a second embodiment of a pushbutton switch according to the present disclosure.
Figure 14:
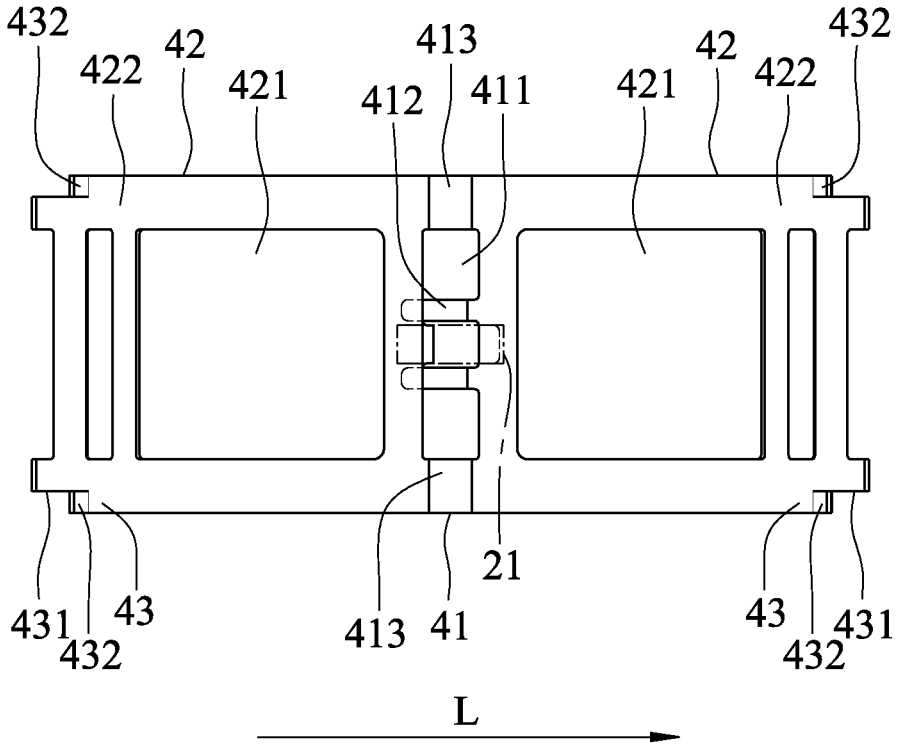
FIG. 14 is a top view of the resilient member of the second embodiment.
Figure 15:
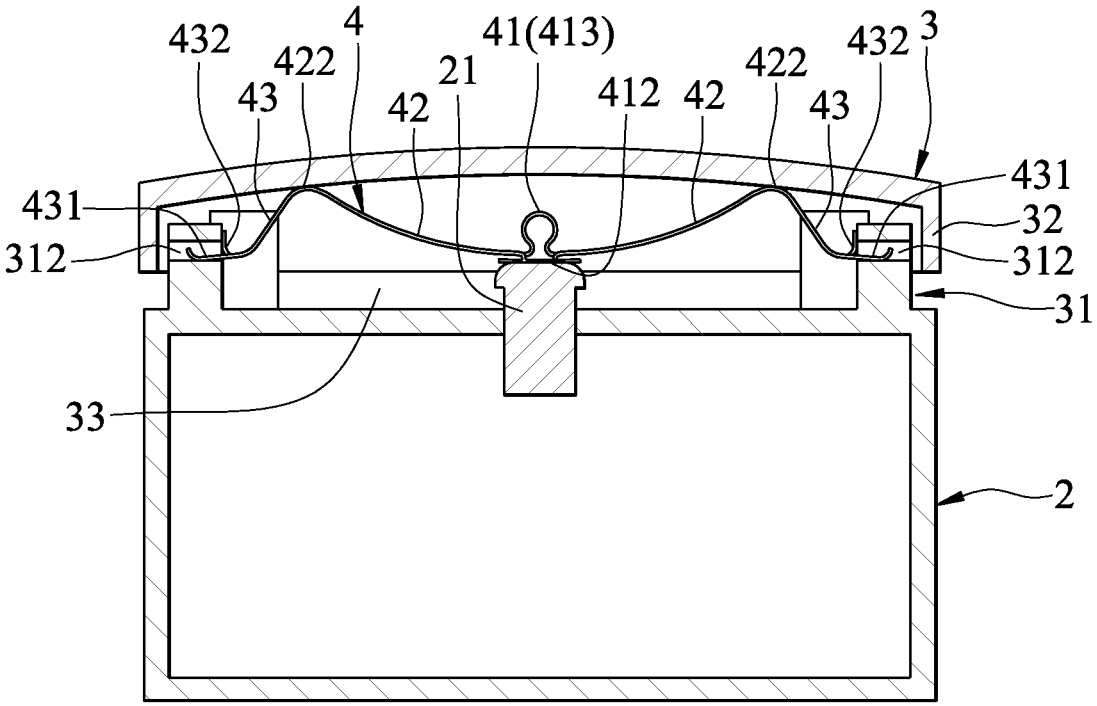
FIG. 15 is a sectional view of the second embodiment.

FIGS. 13 to 15 illustrate a second embodiment of a pushbutton switch according to the pre sent disclosure, which has a configuration similar to that of the first embodiment. Some differences between the first and second embodiments are depicted hereinafter.

In this embodiment, the sliding grooves 312 respectively extend through the seat blocks 311 in the extending direction (L).

In addition, each of the abutment segments 43 of the resilient member 4 further has two stopper sections 432 that are disposed in proximity to the sliding section 431 for abutting against a respective one of the seat blocks 311 to arrest the sliding movement of the sliding section 431 relative to the limiting seat 31. Specifically, for each of the abutment segments 43 of the resilient member 4, the stopper sections 432 are connected respectively to two outer side edges of the sliding section 431 and are spaced apart from each other in the transverse direction. When the resilient arms 42 deform, the stopper sections 432 abut against the respective one of the seat blocks 311 at a position above the sliding groove 312 to arrest the sliding movement of the sliding section 431 relative to the limiting seat 31. The second embodiment has the same advantages as those of the first embodiment.

Figure 16:
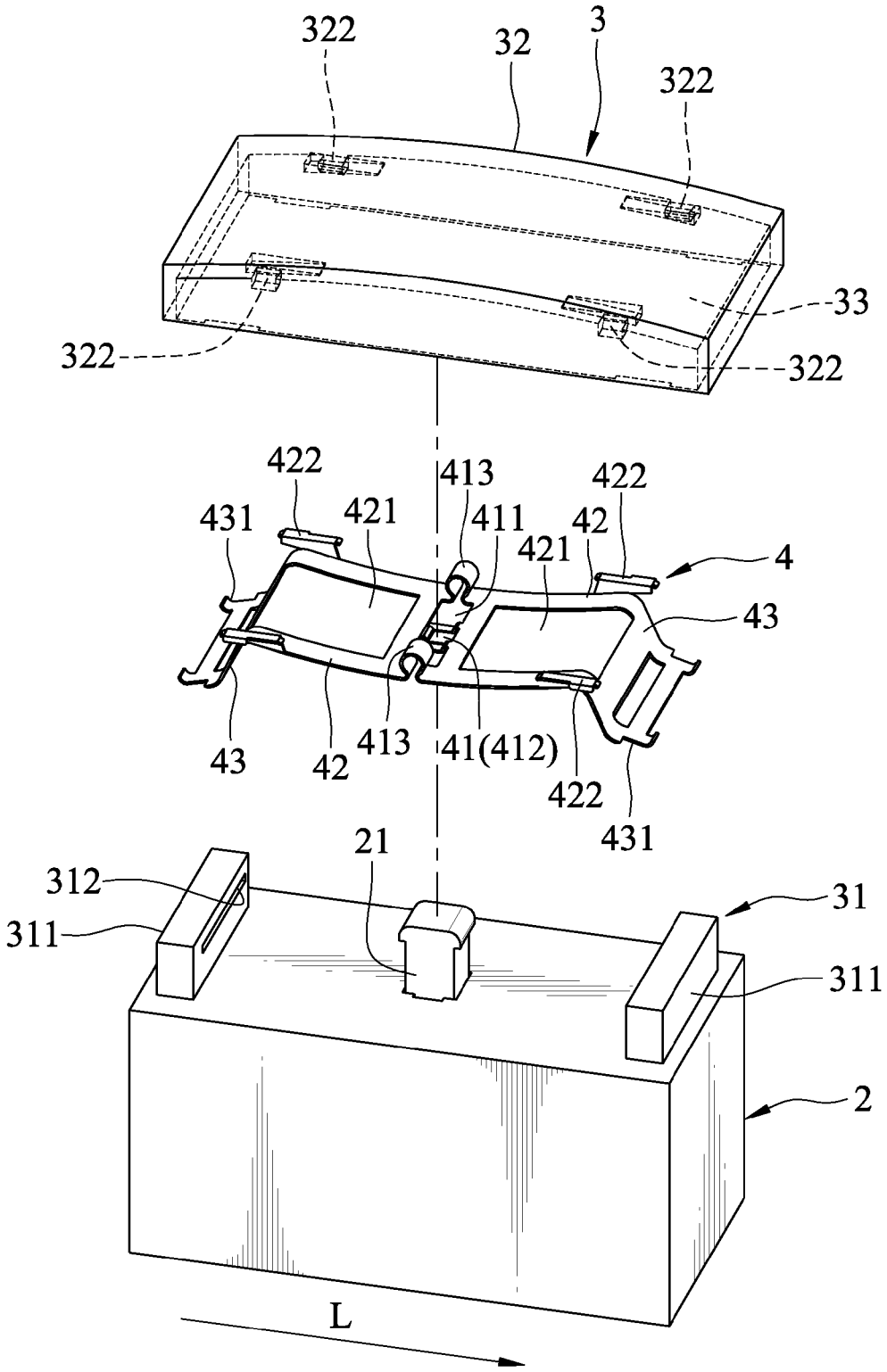
FIG. 16 is an exploded perspective view illustrating a third embodiment of a pushbutton switch according to the present disclosure.
Figure 17:
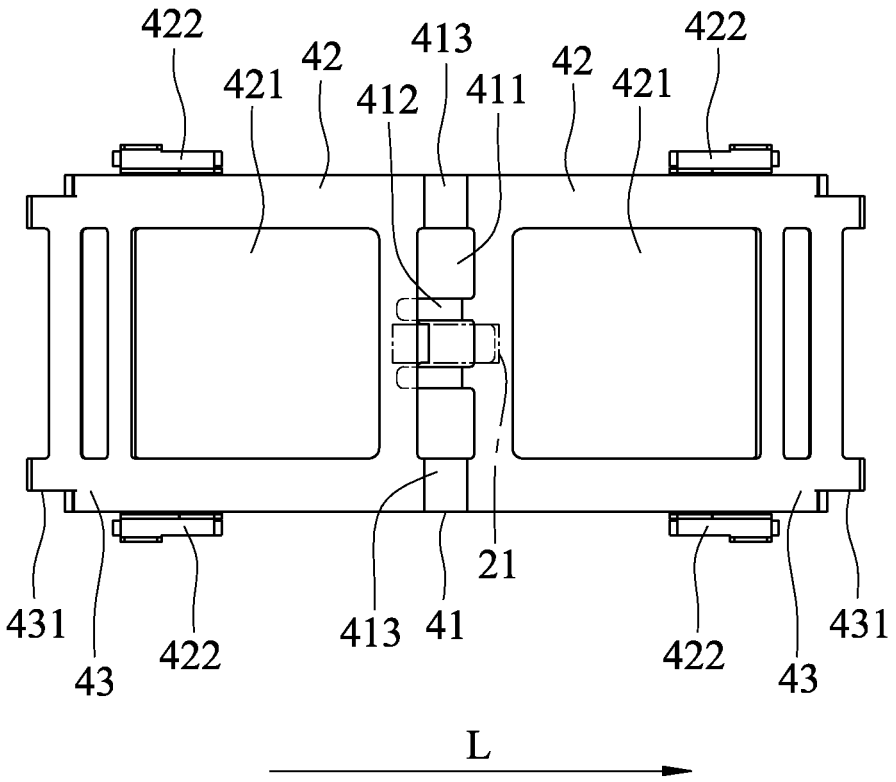
FIG. 17 is a top view of the resilient member of the third embodiment.
Figure 18:
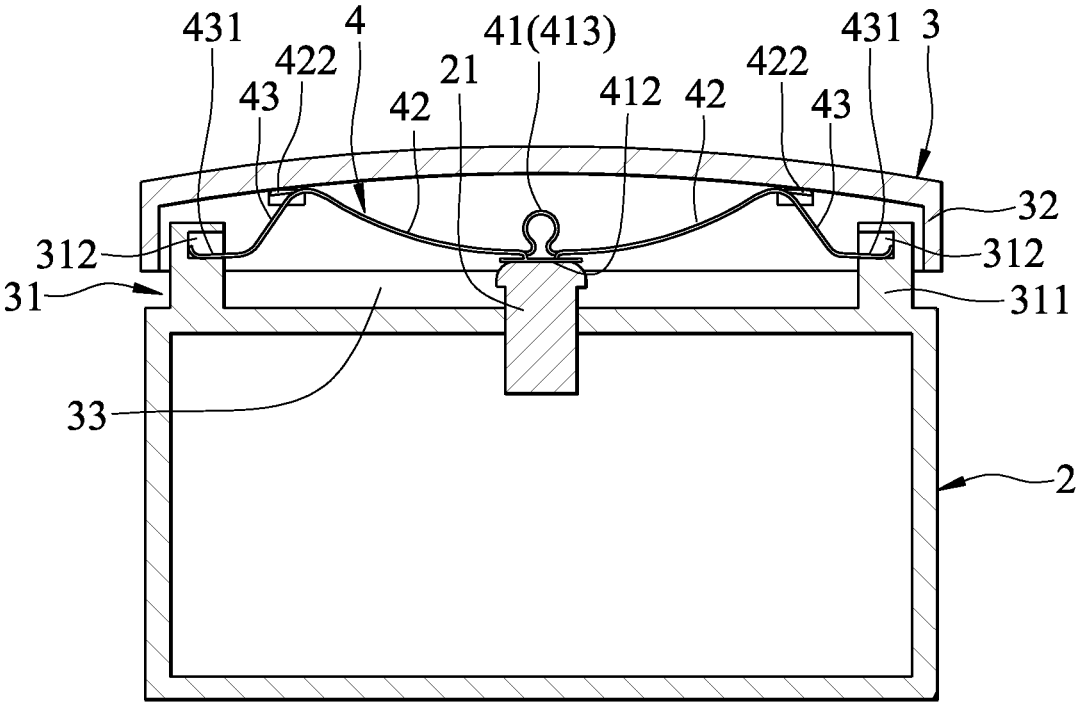
FIG. 18 is a sectional view of the third embodiment.

FIGS. 16 to 18 illustrate the third embodiment of a pushbutton switch according to the present disclosure, which has a configuration similar to that of the first embodiment. Some differences between the first and third embodiments are depicted hereinafter.

In this embodiment, the four limiting portions 313 of the limiting seat 31 and the four locking portions 321 of the pushbutton 32 (see FIG. 7) are omitted. The support sections 422 of each of the resilient arms 42 extend respectively from outer edges of the elongated parts. Specifically, each of the support sections 422 of each of the resilient arms 42 is configured as an engaging plate. The pushbutton 32 has four engaging blocks 322 that respectively engage the support sections 422 of the resilient arms 42. As such, the pushbutton 32 is locked to the limiting seat 31 through the resilient member 4. Moreover, since the pushbutton 32 is directly coupled to the resilient member 4, a force that pushes the pushbutton 32 toward the limiting seat 31 would be directly transmitted to the resilient member 4, thereby further increasing touch sensitivity of the switch assembly 2.

Figure 19:
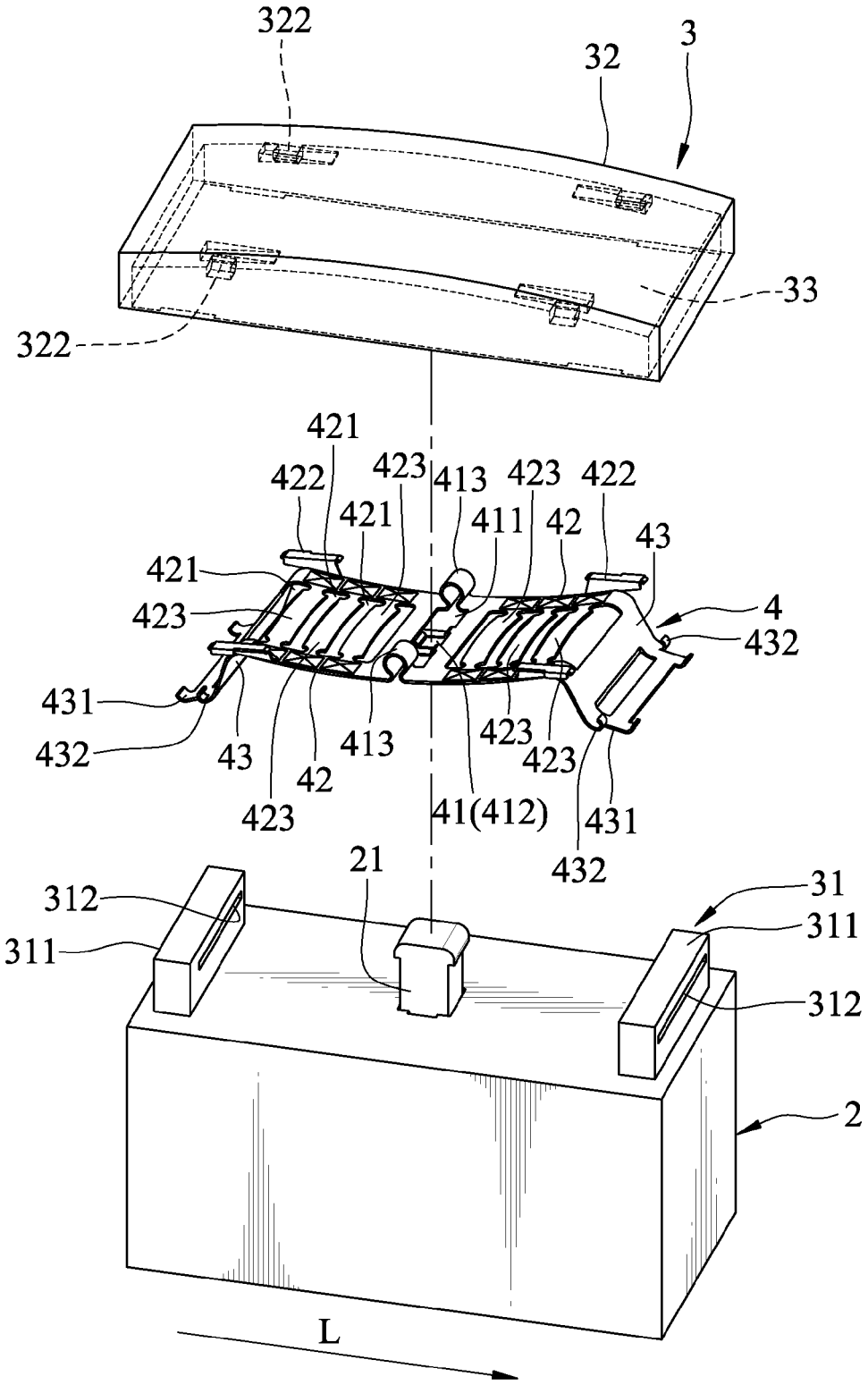
FIG. 19 is an exploded perspective view illustrating a fourth embodiment of a pushbutton switch according to the present disclosure.
Figure 20:
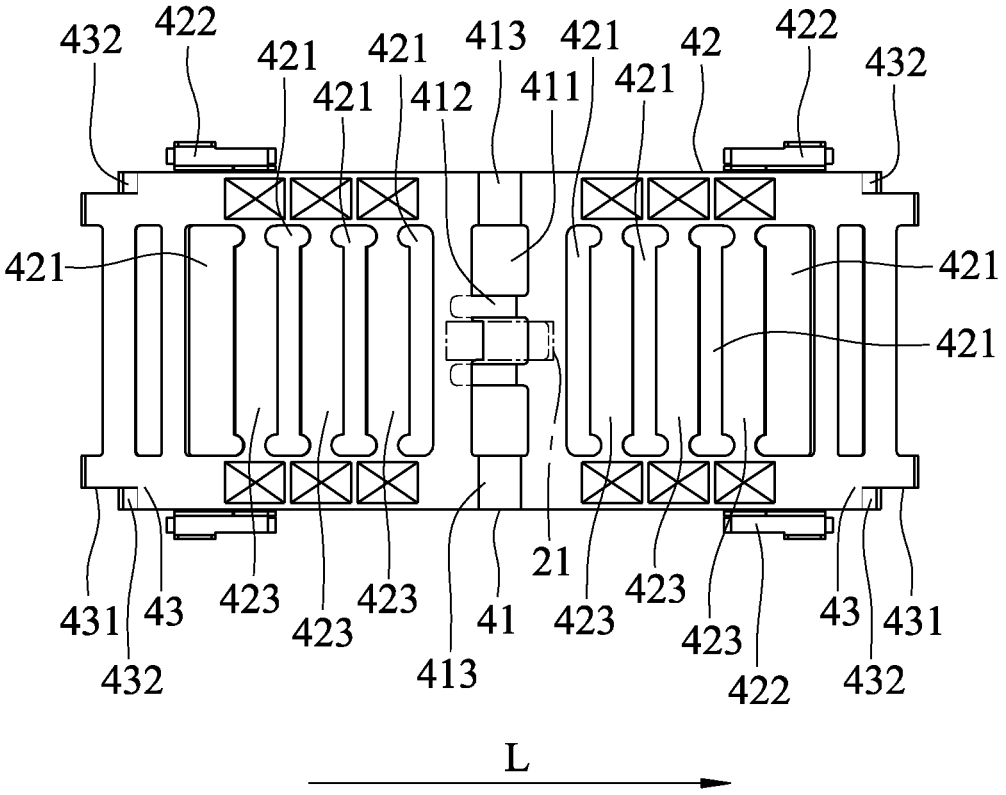
FIG. 20 is a top view of the resilient member of the fourth embodiment.
Figure 21:
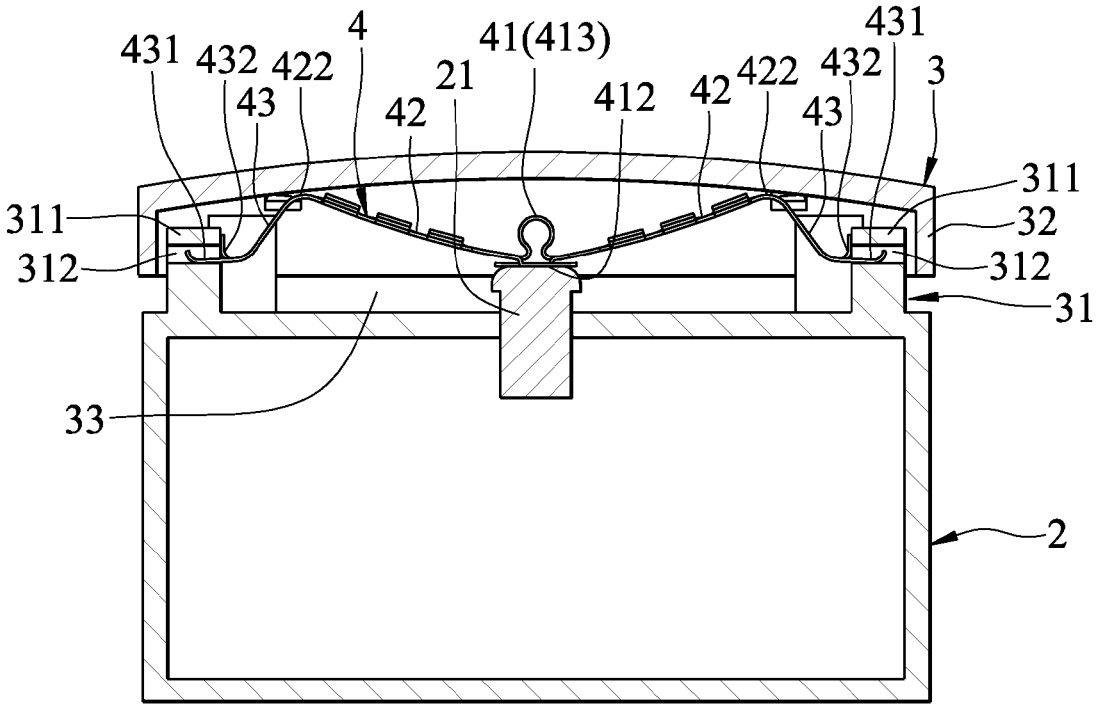
FIG. 21 is a sectional view of the fourth embodiment.

FIGS. 19 to 21 illustrate the fourth embodiment of a pushbutton switch according to the present disclosure, which has a configuration similar to that of the third embodiment. The differences between the third and fourth embodiments are depicted hereinafter.

In this embodiment, the sliding grooves 312 respectively extend through the seat blocks 311 in the extending direction (L).

Moreover, each of the resilient arms 42 has four of the openings 421 that are spaced apart from one another, that are arranged in the extending direction (L) and that divide the respective one of the resilient arms 42 into three reinforcement sections 423. For each of the resilient arms 42, each of the openings 421 is elongated in the transverse direction. The reinforcement sections 423 are capable of distributing an external force exerted on any one of the support sections 422 throughout the resilient member 4, thereby further increasing touch sensitivity of the switch assembly 2 and reinforcing the strength of the resilient arms 42.

In this embodiment, each of the abutment segments 43 of the resilient member 4 further has two stopper sections 432 such as those disclosed in the second embodiment.

While the present disclosure has been described in connection with what are considered the most practical embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pushbutton switch adapted to be connected to an activator of a switch assembly, comprising:

a pushbutton unit including a limiting seat that is adapted to be disposed in proximity to the activator, and a pushbutton that covers said limiting seat and that cooperates with said limiting seat to define a receiving space; and a resilient member disposed in said receiving space and having a switch contactor that is adapted to be disposed adjacent to the activator, and that has opposite ends spaced apart from each other in an extending direction, two resilient arms that extend respectively from said opposite ends of said switch contactor toward said pushbutton, and two abutment segments that are respectively connected to said resilient arms, and that engage said limiting seat;

wherein, when said pushbutton is pressed to move toward said limiting seat, said resilient arms are resiliently deformed to have a resilient force for urging said pushbutton away from said limiting seat, and said switch contactor is driven by said pushbutton to contact and move the activator; and wherein said switch contactor further has:

a void that is formed at a center thereof; and a contact plate that is disposed in said void, and that is connected to one of said resilient arms.

2. The pushbutton switch as claimed in claim 1, wherein said switch contactor of said resilient member further has two linking portions that are spaced apart from each other in a transverse direction transverse to the extending direction and that are separated by said void, each of said linking portions having a drop-shaped cross-section that extends toward said pushbutton.

3. A pushbutton switch adapted to be connected to an activator of a switch assembly, comprising:

a pushbutton unit including a limiting seat that is adapted to be disposed in proximity to the activator, and a pushbutton that covers said limiting seat and that cooperates with said limiting seat to define a receiving space; and a resilient member disposed in said receiving space and having a switch contactor that is adapted to be disposed adjacent to the activator, and that has opposite ends spaced apart from each other in an extending direction, two resilient arms that extend respectively from said opposite ends of said switch contactor toward said pushbutton, and two abutment segments that are respectively connected to said resilient arms, and that engage said limiting seat;

wherein, when said pushbutton is pressed to move toward said limiting seat, said resilient arms are resiliently deformed to have a resilient force for urging said pushbutton away from said limiting seat, and said switch contactor is driven by said pushbutton to contact and move the activator; and wherein each of said resilient arms has two support sections that are spaced apart from each other in a transverse direction transverse to the extending direction, and that abut resiliently against said pushbutton.

4. The pushbutton switch as claimed in claim 3, wherein each of said resilient arms is curved.

5. The pushbutton switch as claimed in claim 3, wherein each of said resilient arms further has at least one opening that separates said support sections from each other.

6. The pushbutton switch as claimed in claim 4, wherein: each of said resilient arms further has two elongated parts spaced apart from each other in the transverse direction, said support sections of each of said resilient arms extending respectively from outer edges of said elongated parts; and said pushbutton has four engaging blocks that respectively engage said support sections of said resilient arms.

7. A pushbutton switch adapted to be connected to an activator of a switch assembly, comprising:

a pushbutton unit including a limiting seat that is adapted to be disposed in proximity to the activator, and a pushbutton that covers said limiting seat and that cooperates with said limiting seat to define a receiving space; and a resilient member disposed in said receiving space and having a switch contactor that is adapted to be disposed adjacent to the activator, and that has opposite ends spaced apart from each other in an extending direction, two resilient arms that extend respectively from said opposite ends of said switch contactor toward said pushbutton, and two abutment segments that are respectively connected to said resilient arms, and that engage said limiting seat;

wherein, when said pushbutton is pressed to move toward said limiting seat, said resilient arms are resiliently deformed to have a resilient force for urging said pushbutton away from said limiting seat, and said switch contactor is driven by said pushbutton to contact and move the activator; and wherein each of said abutment segments extends from a distal end of a respective one of said resilient arms, and has a sliding section that is distal from said distal end of the respective one of said resilient arms and that slidably engages said limiting seat, said sliding section being slidable relative to said limiting seat when the respective one of said resilient arms is deformed.

8. The pushbutton switch as claimed in claim 7, wherein: said limiting seat includes two seat blocks; and each of said abutment segments further has a stopper section that is disposed in proximity to said sliding section for abutting against a respective one of said seat blocks to arrest the sliding movement of said sliding section relative to said limiting seat.

* * * * *